US006354531B1

(12) United States Patent
Aalto et al.

(10) Patent No.: US 6,354,531 B1
(45) Date of Patent: Mar. 12, 2002

(54) APPARATUS AND METHOD FOR CONTINUOUSLY REELING A WEB MATERIAL

(75) Inventors: Esa Aalto, Hyvinkää; Jouni Tulokas, Nurmijärvi; Janne Veräjänkorva, Espoo; Markku Kyytsönen, Numminen, all of (FI)

(73) Assignee: Metso, Paper, Inc., Helsinki (FI)

( * ) Notice: Subject to any disclaimer, the term of this patent is extended or adjusted under 35 U.S.C. 154(b) by 0 days.

(21) Appl. No.: 09/252,484

(22) Filed: Feb. 18, 1999

Related U.S. Application Data

(60) Provisional application No. 60/075,266, filed on Feb. 19, 1998.

(51) Int. Cl.[7] ..... B65H 18/14; B65H 23/02; B65H 23/32

(52) U.S. Cl. ..... 242/542.3; 242/548.1; 242/471; 242/592; 242/615.12

(58) Field of Search ..... 242/548.1, 471, 242/592, 542.3, 534.1, 160.1, 160.4, 907, 534, 615.12; 116/118, 283

(56) References Cited

U.S. PATENT DOCUMENTS

| | | | | |
|---|---|---|---|---|
| 1,945,981 | A | * | 2/1934 | Quinby |
| 2,130,332 | A | * | 9/1938 | Davis |
| 2,281,496 | A | * | 4/1942 | Hanson |
| 2,307,880 | A | * | 1/1943 | Croft et al. |
| 3,235,934 | A | * | 2/1966 | Miller |
| 3,642,222 | A | * | 2/1972 | Leysinger ..... 242/534.1 |
| 4,252,154 | A | * | 2/1981 | Alexander, III ..... 139/304 |
| 4,384,686 | A | * | 5/1983 | Wiley et al. ..... 242/563.1 |
| 4,390,139 | A | | 6/1983 | Alexander, III |
| 4,545,718 | A | * | 10/1985 | Marshall ..... 414/401 |
| 4,763,852 | A | | 8/1988 | Smith |
| 4,860,964 | A | * | 8/1989 | Ishii et al. ..... 242/534.1 |
| 4,889,269 | A | | 12/1989 | Long et al. |
| 4,958,111 | A | * | 9/1990 | Gago ..... 318/6 |
| 5,069,394 | A | | 12/1991 | Panttila |
| 5,251,835 | A | | 10/1993 | Kyytsonen |
| 5,286,348 | A | | 2/1994 | Perin |
| 5,308,010 | A | | 5/1994 | Hakiel ..... 242/75.3 |
| 5,438,920 | A | | 8/1995 | Koivukunnas et al. |
| 5,494,237 | A | | 2/1996 | Summey, III |
| 5,497,957 | A | | 3/1996 | Michel |
| 5,649,448 | A | | 7/1997 | Koskimies et al. |
| 6,013,212 | A | * | 1/2000 | Planeta et al. |

FOREIGN PATENT DOCUMENTS

| | | | |
|---|---|---|---|
| EP | 0 604 558 B1 | | 7/1994 |
| EP | 0 802 141 A2 | | 10/1997 |
| GB | 2 128 171 A | | 4/1984 |
| JP | 57-38258 | * | 3/1982 |
| JP | 58-89551 | * | 5/1983 |

OTHER PUBLICATIONS

Valmet Calenders, Calender Book OL 11 and OL 12, File 1/5, 504, Jiangsu Gold East Paper Co. Ltd., Dagang, China, OMC 1.

JP58–89551 English Abstract.*

JP57–38258 English Abstract.*

Paper Making A General Account of its History, Processes and Applications; Published in 1965 by the Technical Section of the British Paper and Board Makers' Association, Inc.; Fig. 77.*

* cited by examiner

*Primary Examiner*—Donald P. Walsh
*Assistant Examiner*—Minh-Chau Pham
(74) *Attorney, Agent, or Firm*—Connolly Bove Lodge & Hutz, LLP

(57) ABSTRACT

The invention relates to an apparatus for continuously reeling a paper web, especially a high-gloss magazine paper web, around a reel spool. The apparatus comprises means for guiding the paper web towards the reel spool, means for winding the paper web around the reel spool to form a paper roll, and means for positioning the paper web on the roll in different axial positions with respect to said reel spool. The means for positioning the paper web on the roll in different axial positions comprises oscillating means provided for an oscillating movement of the reel spool in cross direction of the paper web.

14 Claims, 7 Drawing Sheets

APPARATUS AND METHOD FOR CONTINUOUSLY REELING A WEB MATERIAL

This application is based on provisional application No. 60/075,266, filed on Feb. 19, 1998.

BACKGROUND OF THE INVENTION

This invention relates to an apparatus of and method for continuously reeling a web material of a paper machine. In particular, this invention relates to continuously reeling a paper web of a paper machine producing paper whose surface properties have been influenced by calendering the paper by using more than one calendering nip.

Traditionally high gloss magazine paper grades such as so called SC-A (Super Calendered Paper) paper has been produced by two stages: in a first stage producing a base paper, and in a second stage, calendering the base paper as a separate operation. For obtaining desired results the base paper has been produced traditionally as follows. The formation and press-drying of the paper web has been performed in a common way for those grades. However, the final solid content of the paper has been increased up to 97–99 per cent of the total mass in order to obtain an even cross directional web moisture profile. After that, the paper has been moisturized to be approximately in moisture content of 6–10 per cent of total paper weight, which is considered to be advantageous for the calendering process. The super calendering is then performed after a while in a separate stage independent from the paper machine where the base paper was manufactured.

Moisturizing or rewetting is possible, for instance with spray application units. An example of this is described in U.S. Pat. No. 5,286,348, the entire disclosure of which is incorporated herein by reference. In U.S. Pat. No. 5,286,348 is described a method for controlling the rewetting apparatus to get an even profile of moisture across the paper width. Rewetting is possible with a very good CD (cross directional) profile.

The problem of rewetting the paper after the drying section with this and other methods is the time needed for paper to absorb the applied water and equalize the moisture content in the direction of thickness and surface areas. If the rewetting is made just before the paper is calendered, the uneven distribution of moisture will affect the final surface properties of the produced paper and the quality grading of the paper will be lowered.

Because of the aforementioned effect in the paper, it is typically reeled up after rewetting and transferred to a waiting station for moisture equalization in the paper web, and then to off-line calenders which are able to produce high gloss and to densify the surface of the paper for final calendering.

Because it was not possible earlier to supercalender high gloss SC-A paper on-line there was no urgent need for improvement. In addition, traditionally supercalendered papergrades such as SC-A and LWC are calendered in two or even three off-line calenders at lower speeds than the papermachine speed to achieve the wanted finishing of the paper.

It has, however, been found that considerable advantages may be achieved by producing SC-paper by using a so called on-line multi-nip calender. This is described in more detail in a co-pending U.S. patent application Ser. No. 09/191,227 "Method for Producing High Gloss Magazine Paper" filed on Nov. 13, 1998 and assigned to the assignee of the present application. The disclosure of the co-pending patent application is incorporated herein by reference, and it describes a process and a new on-line multi-nip calendering concept which makes it possible to also finish premium surface-finished printing paper grades like SCA or LWC grades without additional off-line calendering units, because it is possible to use additional calendering capacity compared to the traditional supercalendering process where nip load is a sum function of the weights of all calendering rolls above each nip and the additional load produced with the uppermost roll of the calendering stack. The concept of using additional calendering capacity is explained in the U.S. Pat. No. 5,438,920, the entire disclosure of which is incorporated herein by reference. This is particularly advantageous in on-line calendering because the additional calendering capacity may be used either for higher finishing or increased capacity of a papermachine.

In such a process or production concept it may be desirable to use, eg., following CD-profile actuators alternatively or simultaneously:

- a profiling steam box in the press section controlled by CD-profile measurement(s) located after the profiling steam box, preferably after the first drying cylinder group, the measurements being preferably moisture profile measurements and/or tension profile measurements and/or temperature profile measurements;
- a CD temperature adjustment in at least one, preferably the last (when only one), of the drying cylinder groups to achieve a uniform temperature profile in web cross direction controlled by a temperature profile measurement unit located after the CD temperature adjustment unit in or between drying cylinder groups or after the last drying cylinder group;
- a moisture profile adjustment before the last drying cylinder group by profiling the drying cylinder surface temperatures and/or using profitable infrared drying units to adjust the moisture of the web and/or using rewetting equipment for profile corrections using the measuring of temperature and/or moisture profile of the web located in or after the last drying cylinder group;
- cooling the web down to the temperature level of the machine hall or the drying section housing before the calendering unit to prevent the continuation of drying of the paper between the calender and the last drying equipment downstream of the headbox and thereby preventing the unequal moisture evaporation from the web before calendering;
- final moisture profile levelling by applying water in the form of steam spray or thin film transferred in the paper in a calender nip or a possible surface sizing unit inside the drying cylinder group or between the last drying cylinder and the calender and controlled by web CD profile measurement located either immediatelly after or before the calender.

Also, the surface sizing unit can be used as a moisture profiler in connection with profile measurements mentioned earlier in this description. The preferable moisture before the first nip of the calender is between 7% and 20% calculated on the basis of the total weight of the web.

Also, it has been recently found that, especially in connection with on-line high gloss magazine paper production, there are some demands for reeling of on-line produced high-gloss magazine paper such as SC-A paper, which demands have not been present in reeling of the base paper or other paper grades. For example it has been found that a possible uneven thickness profile results in difficulties in the winding operation causing CD (cross directional) bumps or bands not only on machine rolls but possibly also on client paper rolls which has a negative effect on the runnability of paper in printing and converting machines.

In paper machines the reeling of web is traditionally performed by using a reel including a driven reeling cylinder over which the paper passes when reeled around a spool being in nip contact with the reeling cylinder. Typically the reeling cylinder is rotatably supported and the reel spool reeling the web is supported by two parallel rails extending in machine direction on both sides of the reel. The reel typically includes also so-called primary and secondary carriages (forks or arms). The reeling on a new reel spool is commenced on the primary carriages and after a certain desired time the secondary carriages take over the supporting of the reel spool and the roll. That kind of a reel is described for example in U.S. Pat. No. 5,251,835, the entire disclosure of which is incorporated herein by reference.

Typically the parameters being used for controlling the reeling process and influencing the results of the reeling are mainly the nip force between the reeling cylinder and the roll as well as the torque of the central-driven reel spool. It is also known to alter the nip force as a function of the roll diameter.

In this context the wording "on-line sc paper machine" is used to stand for a paper machine concept including a wire section, press section, drying section and an on-line calender including more than one calendering nip which have a positive effect on the surface properties of paper.

In such a production line concept there is required a reliable reeling apparatus which provides a continuous operation (reeling/reel change) at operational speeds which typically nowadays exceed 1000 m/min.

OBJECTS AND SUMMARY OF THE INVENTION

It is an intention of the invention to minimize the drawbacks of the known methods. It is also an intention of the invention to minimize problems in reeling of on-line high-gloss magazine paper at a machine reel.

It is also an intention of the invention to provide an advantageous method for providing a reeling process in which the paper reeled on the reel spool will remain at a non-constant cross directional position over the reel spool.

In order to meet the demands set on a on-line sc paper machine as well as on a reeling process of the high-gloss magazine paper, the production line is provided with means of reeling the web on the reel spool of the reeling device at a non-constant cross directional position over the reel spool.

In accordance with a preferred embodiment of the invention in connection with an on-line sc paper machine, the paper machine comprises at least:

- a forming section adapted to produce sc base paper web;
- a press section adapted to water removal by pressing for production of sc base paper web
- a drying section for evaporative drying of sc base paper;
- means for controlling the production of the sc base paper to produce base paper capable of being calendered in an on-line multi nip calender;
- an on-line calender unit producing high-gloss magazine paper;
- paper web oscillating means providing cross directional substantially continuous alternating movement of the paper web after the on-line calender; and
- a reel for reeling the calendered paper web.

In accordance with another embodiment of the invention, a continuous reel for reeling paper web produced in a paper production machine in connection with the reel is provided for producing a machine roll, the reel including at least:

- a reeling cylinder for guiding paper web through a nip between the reeling cylinder and a reel spool at least in reeling position of the reel spool;
- a pair of rails supporting at least the reel spool and the roll being reeled; and
- means for providing a cross-directional, substantially continuous alternating cross directional roll formation position movement of the paper web around the reel spool.

According to a preferred embodiment of the invention, the means for providing the cross directional substantially continuous alternating cross directional roll formation position movement of the paper web around the reel spool comprise a guiding arrangement in the bearing housing of both ends of the reel spool which allows a suitable movement, in direction of the axis of the spool, between the reel spool and at least a section of the outer surface of the bearing housing. This is accomplished according to the invention by providing the bearing with an outer shell capable of controllably sliding in an axial direction.

The oscillating is arranged to take place so that during one oscillation cycle there is at least 100 m but preferably 200 m paper reeled on the roll. By reeling 200 m of paper during each oscillation cycle the quality of the roll is still maintained at a good level.

According to still another embodiment of the invention, the reel having carriages for supporting the reel spool and the roll are provided with means for holding the bearing housings of the reel spool, the means for holding being provided with guiding means which allow a suitable movement in direction of the axis of the spool.

BRIEF DESCRIPTION OF THE DRAWINGS

The following drawings are illustrative of the embodiments of the invention and are not meant to limit the scope of the invention as encompassed by the claims.

DESCRIPTION OF THE PREFERRED EMBODIMENTS

In the following the preferred embodiments of the invention are illustrated by means of the drawings. More particularly in FIG. 1 there is depicted an illustrative presentation of a paper machine for producing high gloss magazine paper like SC-A or LWC. Typical quality targets of woodcontaining printing papers, including SC-A and LWC grades, are given as exemplary information in the table below.

TABLE

Quality targets of woodcontaining printing papers.

| paper grade | brightn. | opacity (%) | gloss (%) | smoothn. PPS10 | density kg/m3 | porosity Bendtsen |
|---|---|---|---|---|---|---|
| SC-A | 67 | 93 | 40–45 | 1,0–1,2 | 1100–1200 | <20 |
| SC-B | 67 | 93 | 30–35 | 1,4–1,6 | 1000 | 40 |
| SC-C | 67 | 93 | 25–30 | 1,8–2,5 | 800 | 60 |
| LWC 35-55 | 68–71 | 90 | 50–55 | 1,0–1,2 | 1200 | <3 |
| LWC 55-70 | 71–75 | 91 | 55–65 | 0,8–1,2 | 1200 | <3 |

Figure 1:
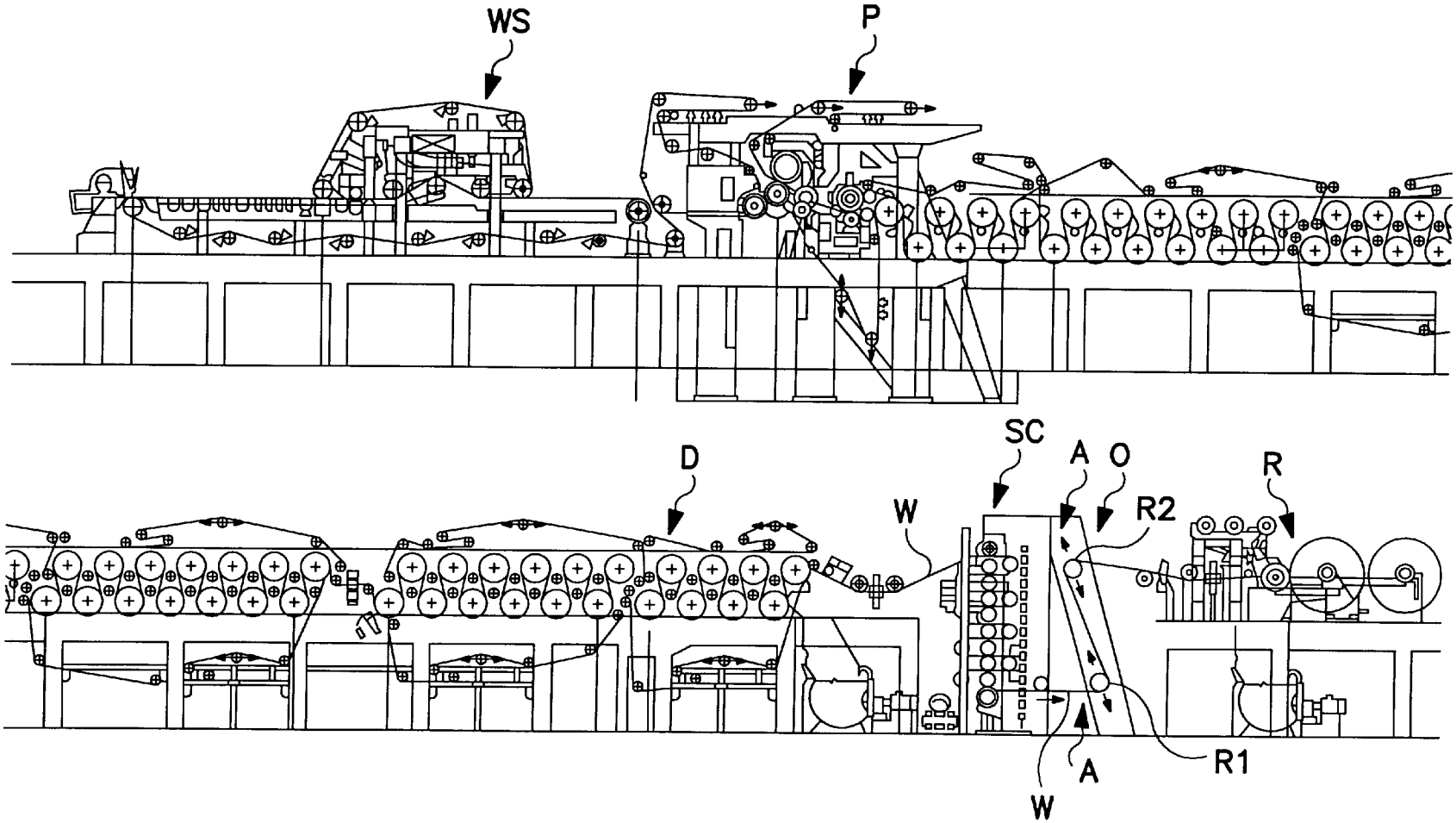
FIG. 1 shows a general illustrative presentation of a sc paper machine according to the invention.

The production line shown in FIG. 1 includes a wet-end of wire section WS wherein the solid content of the paper produced is increased by known methods. After the wire section the paper web W is transferred to a press section P, wherein the paper web is dried by pressing the web, for example, between rolls by assistance of fabrics as known in the art. In a drying section D the drying is typically brought about by means of evaporation. The web is dried and manufactured for example by using methods as described in U.S. Pat. No. 5,649,448, the entire disclosure of which is incorporated herein by reference, in order to produce base paper optimum for the calendering process at a calender section SC. In order to minimize the previously mentioned effects in the reeling process the high-gloss magazine paper production line is provided with means of reeling the web on a reel spool of a reeling device R at varying, non-constant cross directional position over the reel spool. After the calender section SC there is provided a paper web oscillating means O before or in connection with the reel R. As depicted by arrows A, the paper web oscillating means, more precisely its rolls R1, R2, is kept in continuous reciprocating movement for establishing the reeling of web over the reel spool in a manner providing the reeling at non-constant cross directional (direction of axis of the reel spool) position over the reel spool. The method is described in more detail later. By reeling the web at non-constant or alternating position the machine reel results in a better quality when especially on-machine high gloss magazine paper or the like is produced. More particularly this eliminates the possible formation of a sort of bulged bands on the machine reel. Preferably the oscillation cycle is below 100 mm, but more preferably ±1 to ±25 mm. It is also considered advantageous to arrange the reeling to take place so that that during one oscillation cycle there is at least 100 m but preferably 200 m paper reeled on the roll. By reeling 200 m of paper during each oscillation cycle the quality of the roll is still maintained at a very good level.

Figure 2:
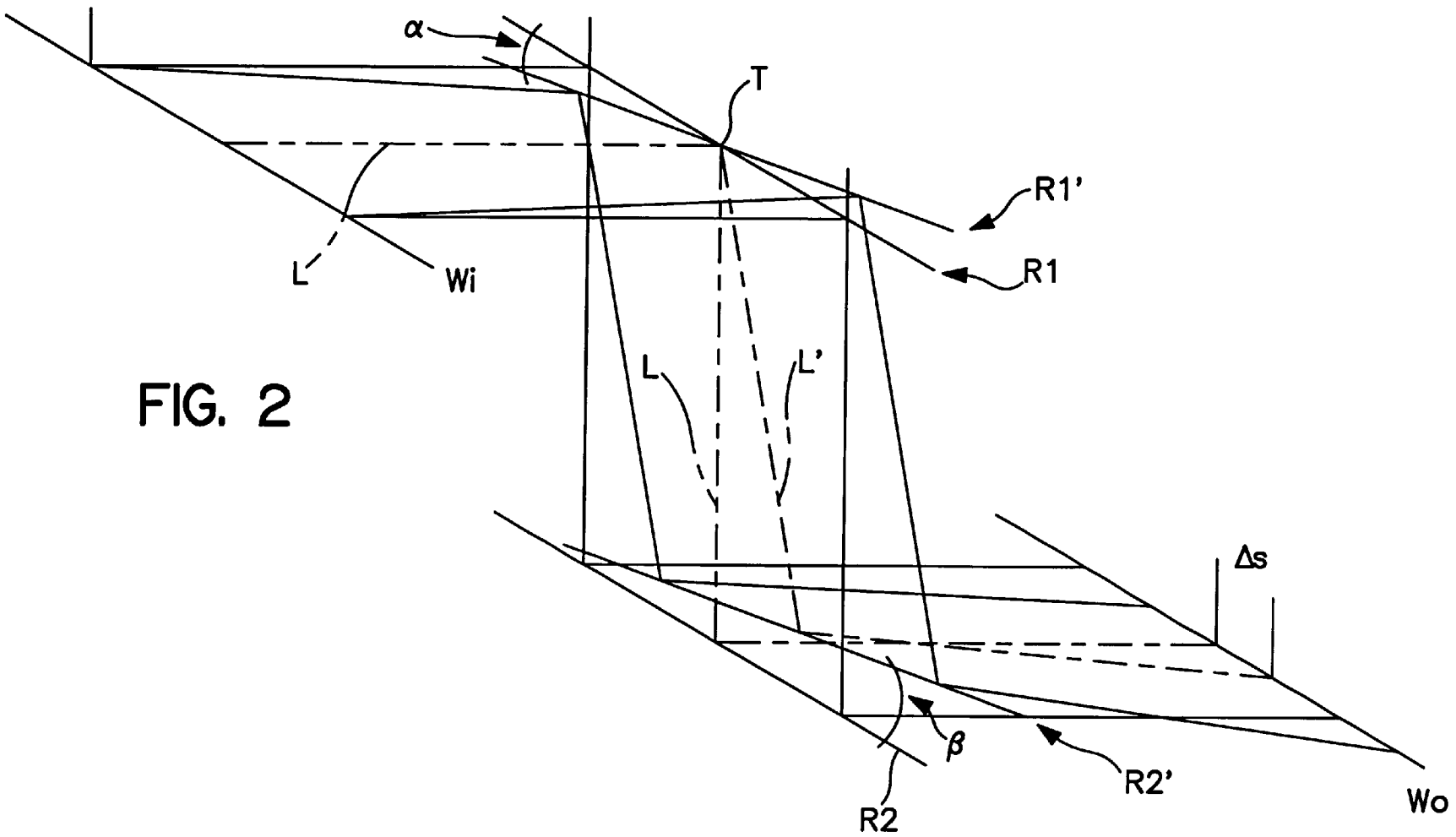
FIG. 2 shows a preferred embodiment of the invention illustrating the principle of web oscillating at the reel of the paper machine.
Figure 3:
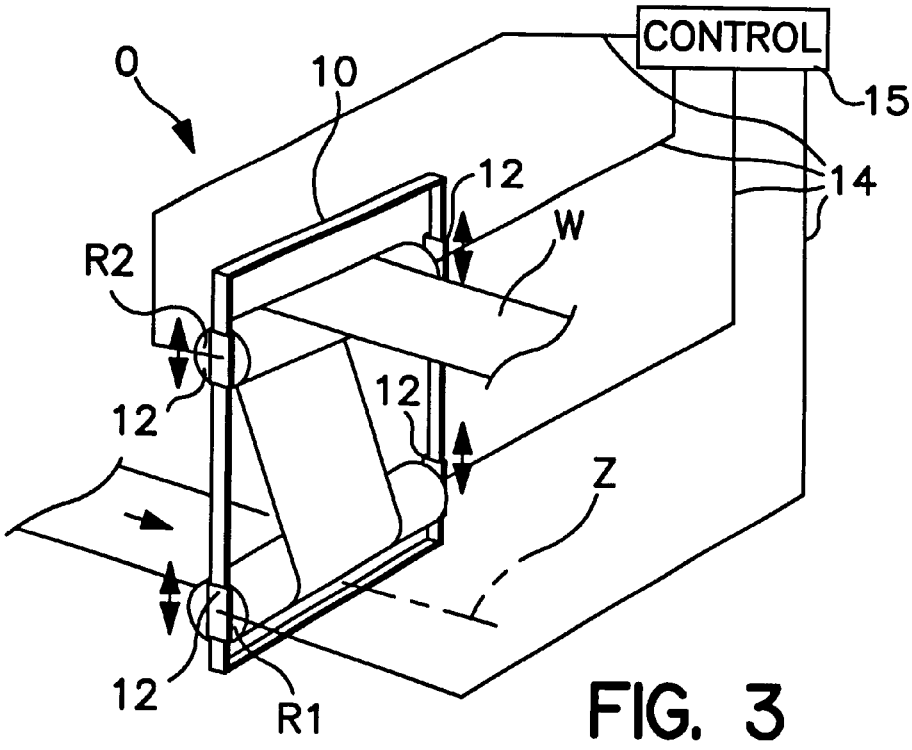
FIG. 3 shows a more detailed view of still another preferred embodiment of the invention.
Figure 4:
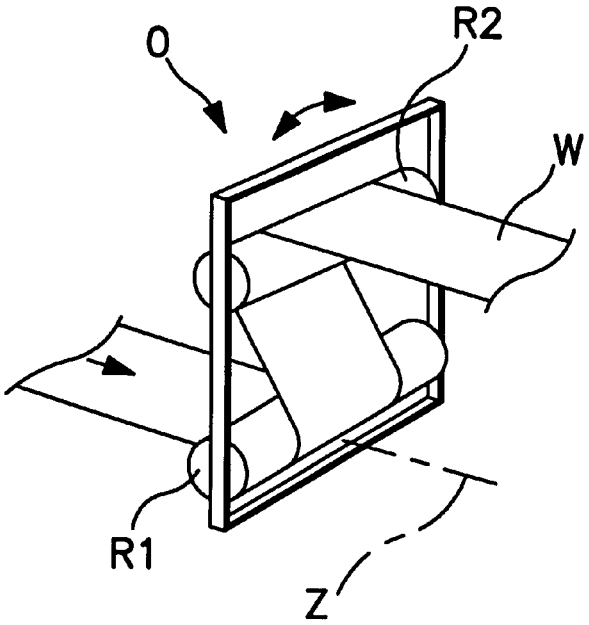
FIG. 4 shows a more detailed view of still another preferred embodiment of the invention where there is a slidingly contacting web travel over the oscillating means according to one embodiment of the invention.

In FIG. 2 there is shown a preferred method of producing oscillation of the web at location O in FIG. 1. The web is coming into the oscillating means at level Wi and leaving at level Wo. In order to obtain lateral movement ΔS of the web, the roll R1, the first roll, is deviated, or rotated to position R1' resulting in a change of angle α between level Wi and R1. At the same time the second roll R2 is deviated in the same direction, resulting in an angle β between level Wo and R2. The rolls R1 and R2 are operationally coupled to each other so that their deviation movement is produced as if the rolls were mechanically coupled and rotated in relation to the center line L of the web at the tangent point T of the coming web and the roll R1, the center line of the web being their common axis of rotation. The run of the center line in the middle, "neutral" position and in the position where it has been shifted due to the rotation of the rolls has been denoted with dash-and-dot lines L, L' respectively. In FIG. 2 the web is travelling from upper level to lower level but it may as well be vice versa, as shown in FIGS. 1, 3 and 4. Other swinging movements of the rolls or corresponding web guide members for laterally shifting the web W are not excluded either.

In FIG. 3 there is shown the oscillating means of FIG. 1 in more detail. The rolls R1, R2 are rotatably arranged on a frame structure 10. End bearings of the rolls are adapted into a controllable guide bar or the like arrangements 12 at boths ends of the rolls, facilitating vertical movements of the ends of the rolls. The guide bar or the like arrangements includes power and data transmission means 14 and control means 15 for producing the mutual synchronized movement of the roll ends which results in movement described in connection with FIG. 2., which may be made to correspond to the swinging movement about the web center line at the tangent point of the entering web and the first roll R1, this common rotational axis bein denoted by letter Z. The rolls may of course be rigidly connected to the frame and the frame itself can be moved about this axis. However, since the masses are considerably high, the first described method is preferred. In the embodiments of FIGS. 2 and 3 there is no slipping between the web and the roll surface.

Figure 5:
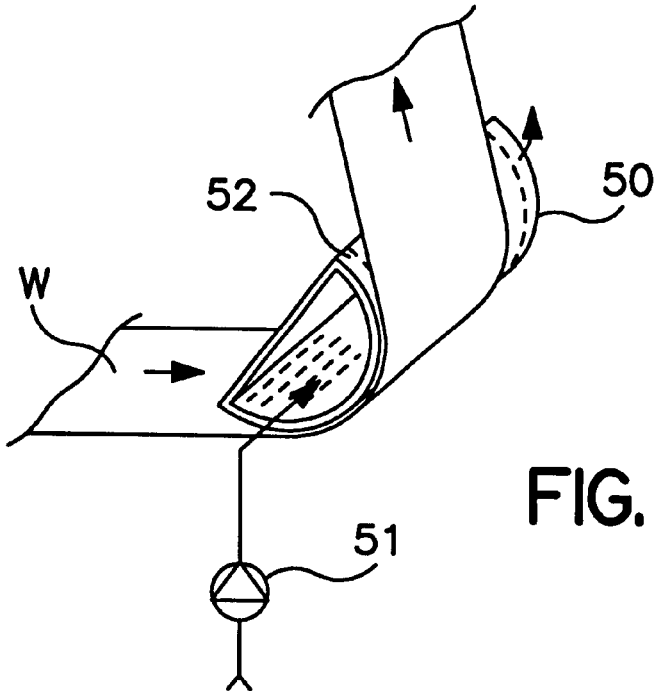
FIG. 5 shows a more detailed view of still another preferred embodiment of the oscillating means according to the invention.

In FIG. 4 there is described another embodiment of the invention. The oscillating means is obtained by arranging the web to slide or float over the rolls. That is possible if the web speed is over 500 m/min and the roll surface is selected suitably. In this embodiment it is possible to arrange the rolls nearer to each other saving space compared to the embodiment in FIG. 3. The rolls may also be replaced by so called air turning devices know for example, in paper coater stations. In such turning devices, illustrated in FIG. 5, the change of direction of the web is obtained by means of air blown through foil surface openings 52 opposite to the web. The air turning device 50 is provided with means for supplying pressurized air into the device, such as a blower 51.

Figure 6:
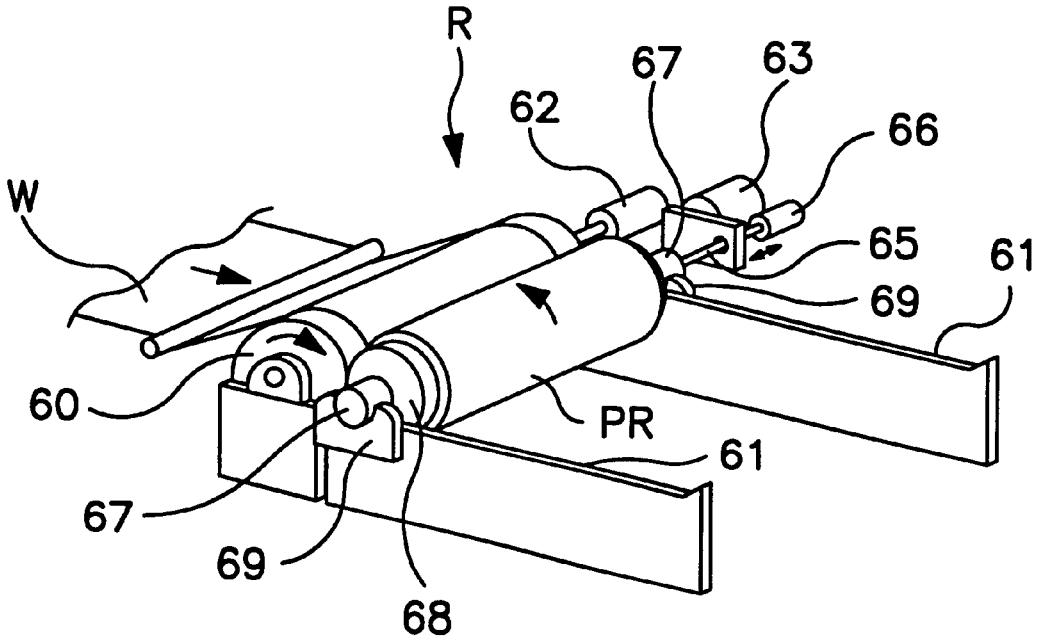
FIG. 6 shows as a more detailed view of a reel according to another preferred embodiment of the invention.

In FIG. 6 there is shown another embodiment of the invention showing a reel R comprising a reeling cylinder 60 rotatably attached to the reel, a pair of rails 61 at both sides of the reel for supporting a reel spool 68 and the paper roll PR. The reeling cylinder is coupled with drive means 62 for driving the cylinder. The reel spool 68 is supported by a carriage 69 at both sides of the reel. The reel spool is provided with means for achieving a cross directional oscillation of the paper web as well as means 66,65,67 for driving the reel spool. The reel spool is also provided with a center drive system 63 with a possible gear. Preferably the reel spool drive system and the means for achieving a cross directional oscillation are integrated so that the drive shaft is used to transmit the oscillation movement to the reel spool including an actuating device 66 (eg. a worm drive, a hydraulic cylinder or the like) coupled with the drive shaft 65. For example a construction for transmitting rotational movement to the drive shaft with a possibility to transmit translational axial movement to the coupling means for the coupling and uncoupling purposes can be applied in this respect with possible appropriate modifications, the construction being described in U.S. Pat. No. 5,069,394, the entire disclosure of which is incorporated herein by reference. Naturally it is possible that the oscillation force may also be conducted to the reel spool separately from the drive shaft.

Figure 7:
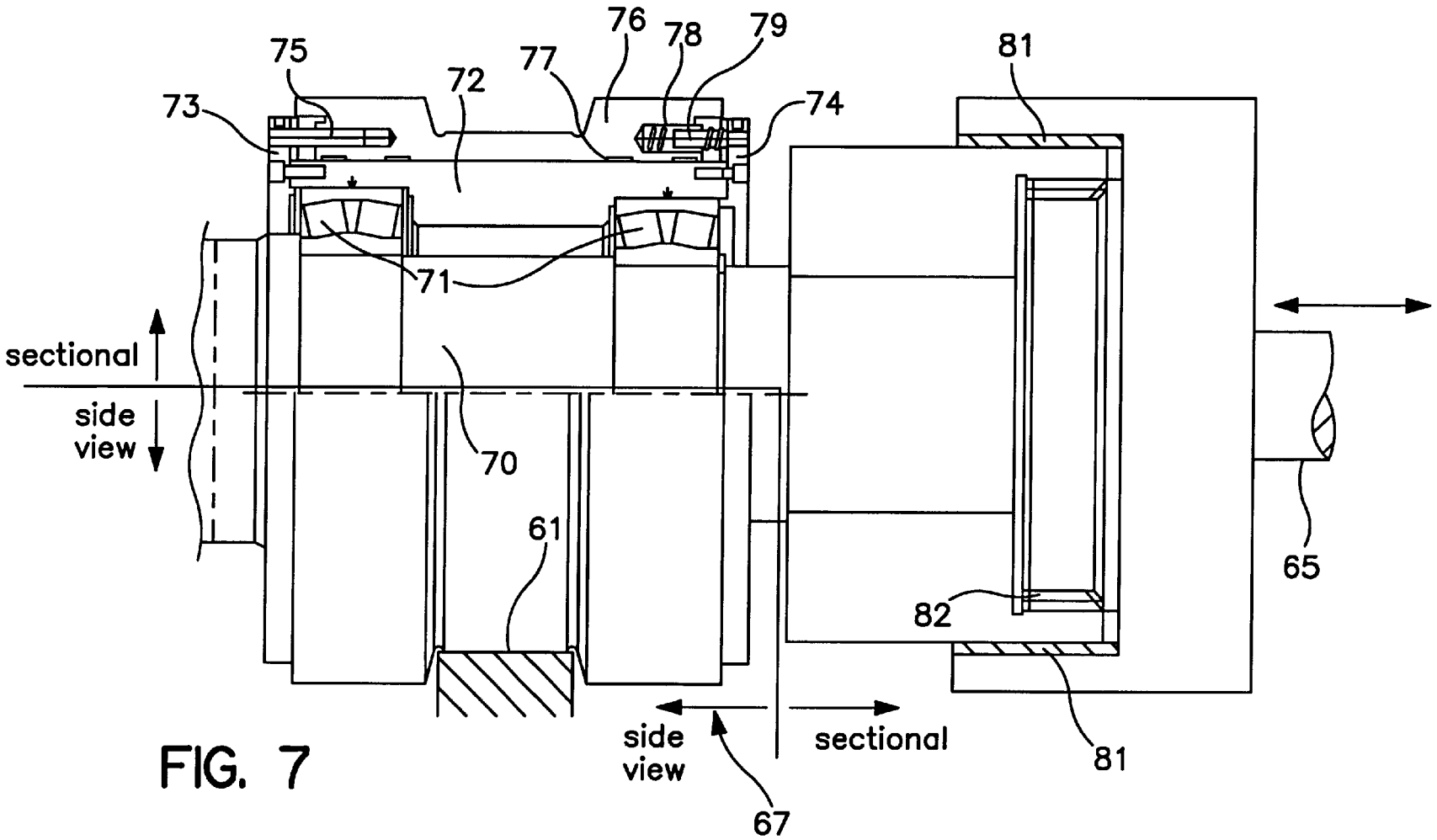
FIG. 7 shows, as a more detailed view of the reel shown in FIG. 6, still another preferred embodiment of the invention.

In FIG. 7 there is shown a more detailed view of still another preferred embodiment of the invention of a reel shown in FIG. 6. FIG. 7 shows a bearing house 67 of the reel spool according to the present invention. The bearing house is provided with a shaft 70 extending through the bearing house, a bearing 71, preferably a roller bearing housed in an inner bearing house body 72, a first bearing cover 73 acting at the same time as guiding cover, a second bearing cover 74 acting at the same time as a spring guide cover, a bearing pin/bush 75 attached to the first bearing cover 73, a spring 78 and a spring guide pin 79 attached to the second bearing cover 74. The first and second bearing covers 73, 74 are fixedly attached to the axially opposite ends of the inner bearing house body 72. There is an outer sliding bush 76 slidably supported by the bearing pin/bush 75, the spring 78 and the spring guide pin 79, which in turn are capable of moving axially with respect to the outer sliding bush 76 when the outer sliding bush 76 is supported in an axially stationary position during the reeling. The outer sliding bush 76 and the bearing housing 72 are separated by a ring shaped glide/slide 77 which operates like an antifriction bearing surface and allows the axial movement of the inner bearing house body 72 together with the shaft 70 with respect to the outer sliding bush 76. The shaft 70 is rotatably supported within the inner bearing house body 72 in an substantially constant axial position with respect to the latter by bearings 71. The shaft 70 is rotatable by means of a drive coupled to a shaft 65 which transmits the rotational drive to the shaft 70 which in a torsionally rigid manner, is connected to the reel spool and brings the reel spool to rotation. The reel spool is supported, for example, on the rails 61 of the reel by means of the outer surface of the outer sliding bush 76 which comprises a circumferentially extending recess for laterally securing the position of the bearing housing 67 on the reel. The rail or a corresponding support structure on the drive side of the reel spool is designated with numeral 61, it being understood that the reel spool in the axially opposite end is supported on its rail or corresponding support structure by a similar bearing housing 67 allowing the axial movement of the rotating reel spool shaft. The spring 78 in connection with the spring guide pin 79 is adapted to set the position of the sliding bush 76 with respect to the inner bearing housing 72 at both ends of the reel spool at predetermined position when the reel spool is detached, eg. lifted up, so that when set down the bearing house is place as it is desired and the outer sliding bush 76 does not move totally freely, which is important.

Figure 9:
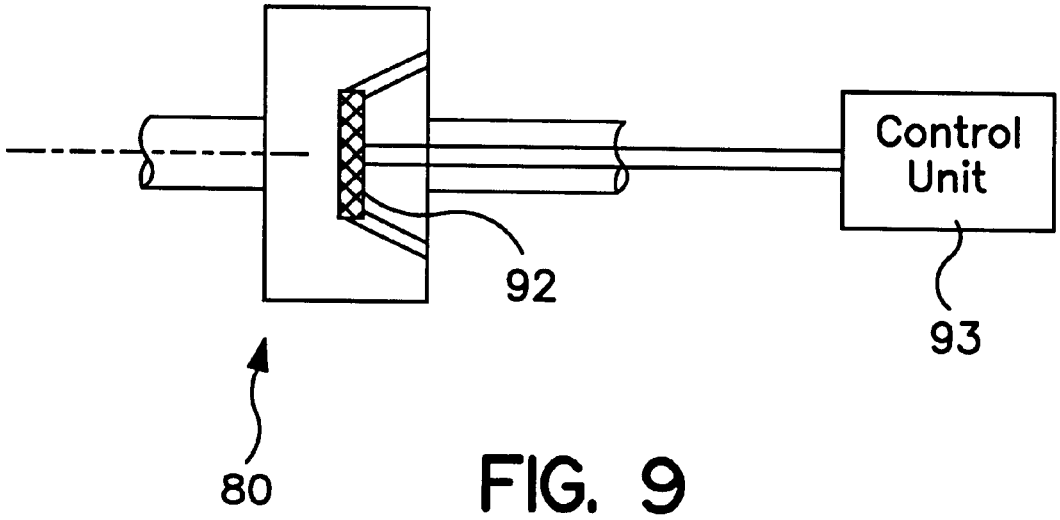
FIG. 9 shows as a view of the connector in FIG. 7 still another preferred embodiment of the invention.
Figure 10:
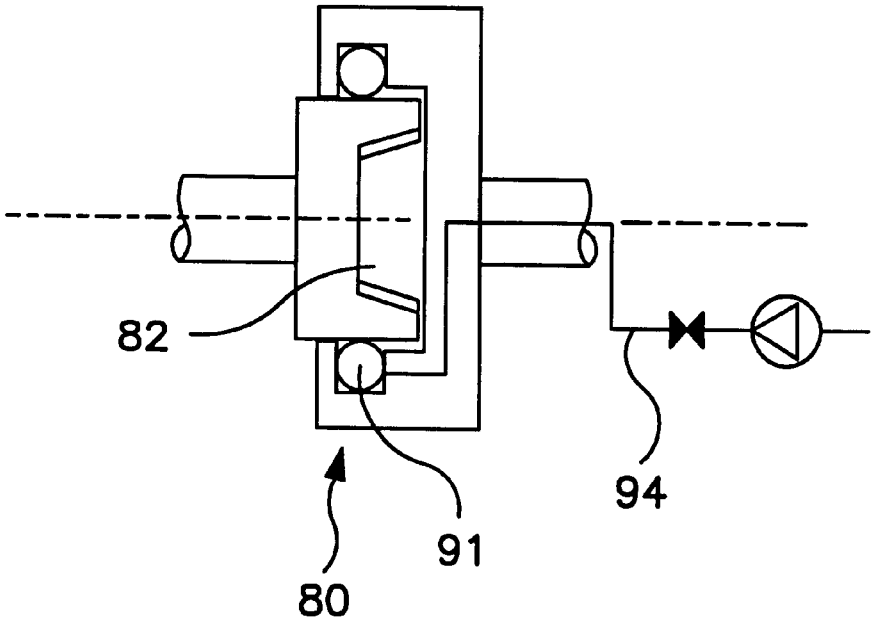
FIG. 10 shows as a view of the connector in FIG. 7 still another preferred embodiment of the invention.

The rotating power is coupled to the reel spool through the shaft 70 by a connector 80 including power transmission surfaces 82 for transmitting the rotational power from the first part of the connector attached to the drive shaft 65 to the second part of the connector attached to the reel spool shaft 70. The first part and the second part are mutually connectable and disconnectable, and in this connection reference is made to U.S. Pat. No. 5,069,394, incorporated herein by reference. For providing the axial oscillating movement, the connector includes means 81 between the first part and second part for attaching the drive shaft 65 to the reel spool. The means 81 may be for example a controllable friction surface allowing axial power transmission. As is shown in FIG. 10, the means 81 may be a hose 91 or the like and pressurizing means 94 (preferably pressurized air) for applying pressure inside the hose or the like providing the grip to the connector 80 of the reel spool. As is further shown in FIG. 9, according to another embodiment the connector 80 may include between its parts a magnetical oscillation power transmission means 92 controlled by a control unit 93.

Figure 8:
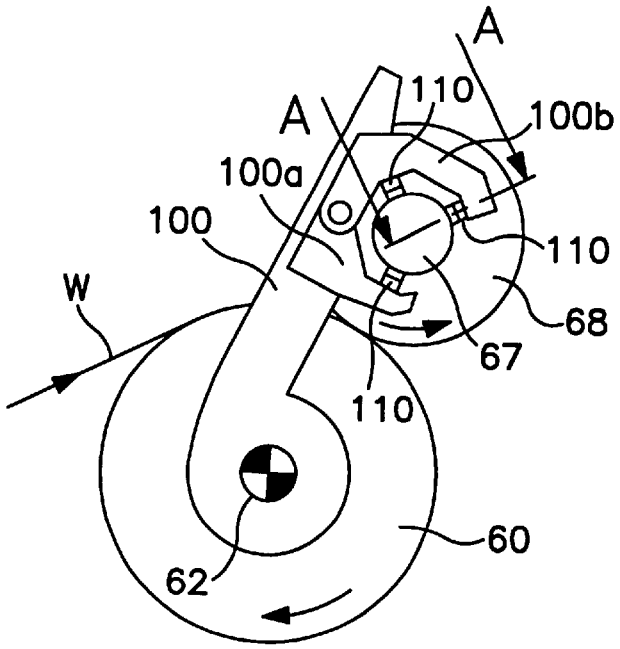
FIG. 8 shows, as a more detailed view of the reel shown in FIG. 6, still another preferred embodiment of the invention.
Figure 8A:
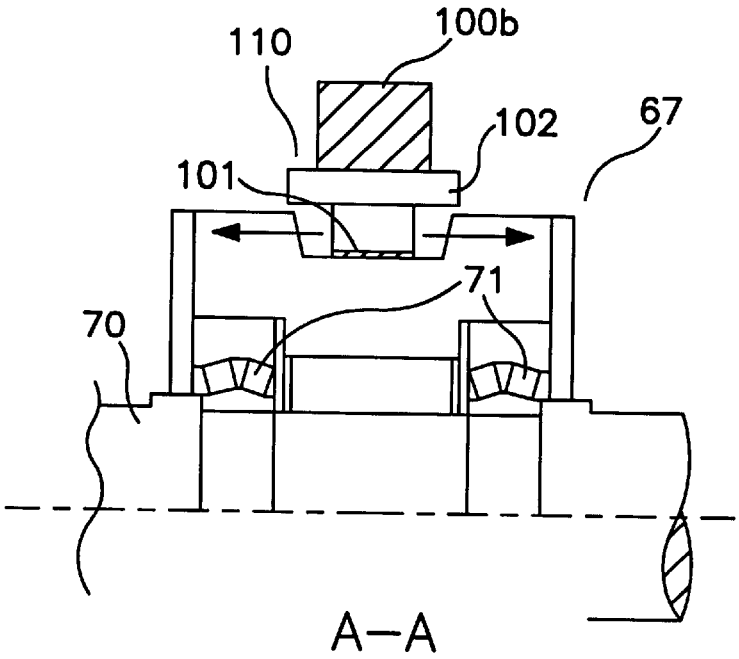
FIG. 8A shows a cross-section view of FIG. 8 through A—A.

In FIG. 8 there is shown, as a more detailed view of the reel shown in FIG. 6, a still another preferred embodiment of the invention where, as in the preceding embodiment, an external actuator is used to cause a reciprocating axial movement of the reel spool while the reel spool is gathering the web to a roll. FIG. 8 is an illustration of a reel showing a reeling cylinder 60 and primary arms 100 (the arm on the opposite side not shown). It should be understood that even if this embodiment is explained in connection with a primary arm the same idea may be easily adapted to secondary carriages (or rails) also. As known, the function of the primary arms is to support the reel spool and move the reel spool towards the secondary arms, carriages or the like or hold the reel spool in connection with the secondary arms, carriages or the like before it is taken over by the latter, while the web is being wound on the reel spool. In the primary arm the reel spool 68 is held by jaws or the like 100*a*, 100*b*, which hold the bearing housing 67 of the reel spool 68 therebetween. The jaws are provided with blocks 110 which include a friction surface 101 ensuring a firm grip on the outer surface of the bearing housing 67. The friction surface 101 is included in a piece arranged to be movable along a guide bar, guide block or the like means 102 for allowing the oscillation as explained before. This is shown more clearly in detailed view of section A—A, and from there it will be apparent that the entire bearing housing 67 and consequently the reel spool is movable in an axial direction back and forth by means of an actuator connected to the drive shaft 70, the interface of movement being in this case in the block 110. It will be also apparent that, even though the point of contact between the bearing housing 67 and the arm 100 is in the area of the circumferential recess of the bearing housing, it can be elsewhere as determined by the construction and operation of the reel, such as on the circumferential surface next to the recess closer to the reel spool.

It is also possible to transmit the oscillating movement to a frame construction supporting a reel spool which has a substantially constant position in machine direction while the reeling cylinder changes its position in machine direction as the roll diameter increases. The invention also encompasses all arrangements where a relative oscillating movement is created between the reeling cylinder and reel spool in order to position the continuous web on the roll at differing axial positions in accordance with the oscillating movement.

The examples provided above are not meant to be exclusive. Many other variations of the present invention would be obvious to those skilled in the art, and are contemplated to be within the scope of the appended claims.

What is claimed is:

1. An apparatus for continuously producing a paper web and for continuously reeling the paper web around a reel spool comprising:

means for manufacturing and drying the paper web in a production line, means for calendering the paper web to produce an on-line calendered paper web in the same production line, means for guiding the on-line calendered paper web towards the reel spool, means for winding the on-line calendered paper web around the reel spool to form a paper roll, and means for positioning the on-line calendered paper web on the paper roll in different axial positions with respect to said reel spool, and wherein the means for positioning the paper web on the roll in different axial positions comprises oscillating means provided for an oscillating movement; and wherein the oscillating means comprises the means for guiding the paper web located before the reel spool, said means for guiding the paper web being arranged to cause by their oscillating movement a lateral movement of the paper web.

2. The apparatus as claimed in claim 1, wherein the means for guiding the paper web comprise a first guiding member and a second guiding member, said first and second guiding members being provided for oscillation to produce deviations in their positions which cause the lateral movement of paper web.

3. The apparatus as claimed in claim 2, wherein the first guiding member and the second guiding member are arranged on a common frame structure.

4. The apparatus as claimed in claim 3, wherein said frame structure is provided for oscillation.

5. The apparatus as claimed in claim 3, wherein the first guiding member and the second guiding member are provided for oscillation with respect to the frame structure.

6. The apparatus as claimed in claim 3, wherein the first guiding member and the second guiding member are rolls.

7. The apparatus as claimed in claim 3, wherein the first guiding member and the second guiding member are air turning devices.

8. A method for continuously producing a paper web and for continuously reeling the paper web around a reel spool comprising the steps of:

a) manufacturing and drying the paper web in a production line, b) calendering the paper web to produce an on-line calendered web in the same production line, c) guiding the on-line calendered paper web towards the reel spool, d) winding the on-line calendered paper web around the reel spool to form a paper roll, and e) positioning the on-line calendered paper web on the paper roll in different axial positions with respect to said reel spool; and wherein the paper web is positioned on the roll in different axial positions by means of an oscillating movement; and wherein the paper web is brought to oscillating lateral movement before the reel spool.

9. The method as claimed in claim 8, wherein the paper web is brought to oscillating lateral movement by oscillating guiding means guiding the paper web before the reel spool.

10. The method as claimed in claim 8, wherein the oscillation takes place with a cycle of below 100 mm expressed as difference of position of the paper web on the roll.

11. The method as claimed in claim 8, wherein during one oscillation cycle at least 100 m paper web is wound around the reel spool.

12. The method as claimed in claim 11, wherein during one oscillation cycle at least 200 m paper web is wound around the reel spool.

13. The method as claimed in claim 8, wherein the paper web is calendered in a multi-nip calender.

14. The method as claimed in claim 13 wherein the paper web wound around the reel spool is high-gloss magazine paper.

* * * * *